US010906848B2

(12) United States Patent
Conroy et al.

(10) Patent No.: US 10,906,848 B2
(45) Date of Patent: Feb. 2, 2021

(54) PROPELLANT GRAIN FOR OPTIMIZING THE INTERIOR BALLISTIC PERFORMANCE OF A WEAPON

(71) Applicant: U.S. Army Research Laboratory ATTN: RDRL-LOC-I, Adelphi, MD (US)

(72) Inventors: Paul J. Conroy, Churchville, MD (US); Raymond A. Wildman, Wilmington, DE (US); Eric J. Robinette, Wilmington, DE (US); John R. Schmidt, Bel Air, MD (US); Andrew T. Gaynor, Baltimore, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 309 days.

(21) Appl. No.: 15/466,893

(22) Filed: Mar. 23, 2017

(65) Prior Publication Data

US 2018/0273438 A1 Sep. 27, 2018

(51) Int. Cl.
*C06B 21/00* (2006.01)
*C06B 45/00* (2006.01)

(52) U.S. Cl.
CPC ..... *C06B 21/0033* (2013.01); *C06B 45/00* (2013.01)

(58) Field of Classification Search
CPC ..... C06B 21/0033; C06B 45/00
See application file for complete search history.

(56) References Cited

U.S. PATENT DOCUMENTS

2002/0079680 A1* 6/2002 Moquin ..... B60R 22/4628 280/736
2010/0294113 A1* 11/2010 McPherson ..... C06B 21/0008 86/1.1
2018/0057414 A1* 3/2018 O'Brien ..... B33Y 10/00

OTHER PUBLICATIONS

Chemically Collapsible Mandrel for Solid Rocket Motor Processing, Dey, Jul./Sep. 2015.*

* cited by examiner

*Primary Examiner* — Aileen B Felton
(74) *Attorney, Agent, or Firm* — Alan I. Kalb

(57) ABSTRACT

A method of manufacturing and optimizing energetic propellant grains includes generating an optimal surface area to mass fraction burned ratio profile for a predetermined solid structure including propellant grains; using the profile as a target function of a topological optimization process to generate a 3D form of a propellant grain; developing a negative of the 3D form of the propellant grain; mixing and densifying the negative with an energetic material in an uncured form in a mixer to create a structure including the energetic material and embedded negative; and solvating the negative from the structure, wherein the negative comprises a 3D propellant grain. The developing of the negative of the 3D form of the propellant grain may occur using a predetermined material in an additive manufacturing process. The negative may be soluble in the predetermined material, and the energetic material may be insoluble in the predetermined material.

8 Claims, 9 Drawing Sheets

PROPELLANT GRAIN FOR OPTIMIZING THE INTERIOR BALLISTIC PERFORMANCE OF A WEAPON

GOVERNMENT INTEREST

The embodiments herein may be manufactured, used, and/or licensed by or for the United States Government without the payment of royalties thereon.

BACKGROUND

Technical Field

The embodiments herein generally relate to weapons technologies, and more particularly to propellant grain configuration.

Description of the Related Art

Advancement in Interior Ballistic (IB) performance is mostly measured in increased muzzle velocity. The goal of interior ballistics for the past few years has been to increase the muzzle velocity within the limits provided by the gun barrel. These limits historically have been permissible due to the maximum pressure from the barrel design as well as gun wear life as resulting from the barrel/liner/coating. Generally, the two methods used to increase performance are to increase the energy content of the propellant thus requiring less mass per charge in addition to increasing the area under the pressure time profile to maximize the potential work to be applied to the projectile. FIG. 1 demonstrates the pressure maximization profile using a pressure-travel (P-T) plot, with the top curve 10 representing the design pressure of the barrel. The bottom curve 12 is that of the pressure produced by a typical solid propellant charge with a safety margin between the two curves 10, 12. The middle curve 11 represents what has long been sought for, a pressure curve which more closely follows the idealized constant pressure (CONPRESS) gun profile. This third pressure profile provides considerable more work on the projectile during firing and results in additional muzzle velocity, as represented by the area under the P-T curve, to accelerate the projectile than the traditional pressure time curve below it.

One way to obtain a better P-T profile is to optimize the progressivity of the propellant for a specific gun system. Progressivity is represented by the increase in mass generation rate of gases as a function of depth of the propellant burned as a function of projectile travel. There are two common methods of obtaining progressivity. The first one involves geometric progressivity in which the surface area of the propellant increases with depth burned assuming Piobert's Law. The second involves chemical modifications such that the burn rate of the propellant changes as a function of burn depth. Both of these methods could be and are employed coincidentally in some circumstances. Chemical progressivity usually involves additives to a given propellant to inhibit or reduce the burn rate or energy content of a portion of the propellant to control the mass generation rate during the ballistic cycle. This invariably involves reducing the total energy available to the system for a given charge mass, therefore reducing the available energy to do work on the projectile.

Geometric progressivity relies upon the possible shapes of the propellant to evolve more surface area as the IB cycle proceeds. Presently, these shapes are in turn dependent upon manufacturing technology to inexpensively process the propellant into a stable shape. Currently, propellants are extruded, rolled, or tumbled in machines similar to those that manufacture pasta or candies. This tends to limit the shape of the grains to extruded playdough shapes, or slabs, with possible perforations in addition to spheroidal or spheroidal with specified web propellant "balls" with possible perforations and the like. FIG. 2 shows the surface area as a function of depth burned for various grain geometries. Some are regressive, as in sphere and slab, and some are quite progressive, such as the 19-perforated (perf) grain geometry. The current propellant form functions have exhausted their progressivity potential. Moreover, conventional systems obtain between 80-95% maximum performance. Generally, no propellant grain manufactured or designed to date entirely exploits the potential available from the barrel design limit.

SUMMARY

In view of the foregoing, an embodiment herein provides a method of manufacturing and optimizing energetic propellant grains, the method comprising generating an optimal surface area to mass fraction burned ratio profile for a predetermined solid structure comprising propellant grains; using the profile as a target function of a topological optimization process to generate a three-dimensional (3D) form of a propellant grain; developing a negative of the 3D form of the propellant grain; mixing and densifying the negative with an energetic material in an uncured form in a mixer to create a structure comprising the energetic material and embedded negative; and solvating the negative from the structure, wherein the negative comprises a 3D propellant grain. The developing of the negative of the 3D form of the propellant grain may occur using a predetermined material in an additive manufacturing process. The negative may be soluble in the predetermined material, and the energetic material may be insoluble in the predetermined material. The optimal surface area to mass fraction burned ratio may be at least 5. The generating of the optimal surface area to mass fraction burned ratio profile for a predetermined solid structure may comprise a constant pressure IB profile. The 3D form of the propellant grain may comprise a solid contiguous structure. The mixer may comprise a resonant acoustic mixer (RAM). The 3D form of the propellant grain may comprise a rocket motor grain. The 3D form of the propellant grain may comprise a gun propellant grain. The 3D form of the propellant grain may comprise a pharmaceutical compound.

Another embodiment provides a method of manufacturing and optimizing energetic propellant grains for a weapon, the method comprising generating an optimal surface area to mass fraction burned ratio profile for a predetermined weapon/projectile combination using interior ballistics (IB); using the profile as a target function of a topological optimization process to generate a 3D form of a propellant grain; developing a negative of the 3D form of the propellant grain; mixing and densifying the negative with an energetic material in an uncured form in a mixer to create a structure comprising the energetic material and embedded negative; and solvating the negative from the structure, wherein the negative comprises a 3D propellant grain of the predetermined weapon/projectile combination. The developing of the negative of the 3D form of the propellant grain may occur using a predetermined material in an additive manufacturing process. The negative may be soluble in the predetermined material, and the energetic material may be insoluble in the predetermined material. The optimal surface area to mass fraction burned ratio may be at least 5. The generating of the optimal surface area to mass fraction burned ratio profile for a predetermined projectile may comprise a constant pressure IB profile. The 3D propellant grain may cause a constant pressure in the weapon over a ballistic cycle of the weapon. The 3D form of the propellant grain may comprise a solid contiguous structure. The solid contiguous structure may comprise any of occluded and embedded shapes. The constant pressure IB profile may maximize the available work to the projectile during an IB cycle of the weapon. The mixer may comprise a RAM.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The embodiments herein will be better understood from the following detailed description with reference to the drawings, in which.

DETAILED DESCRIPTION

Figure 1:
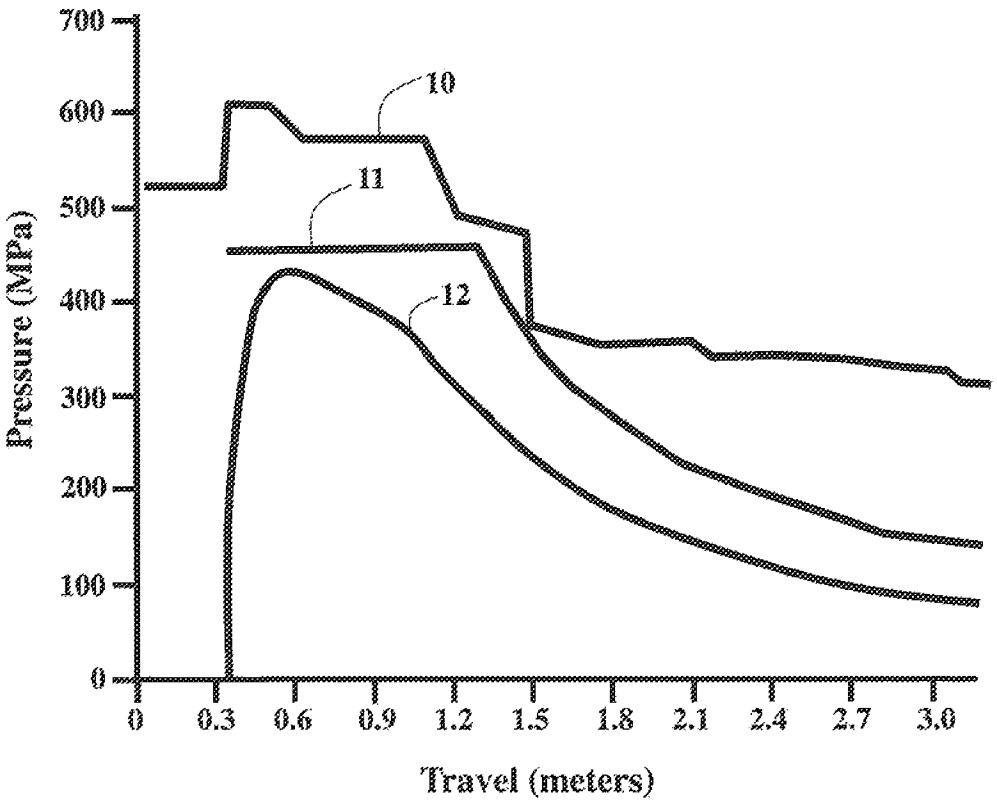
FIG. 1 (Prior Art)
FIG. 1 is a graphical representation illustrating pressure vs. travel curves showing pressure limits for barrel design, current charge design, and optimal charge design.
Figure 2:
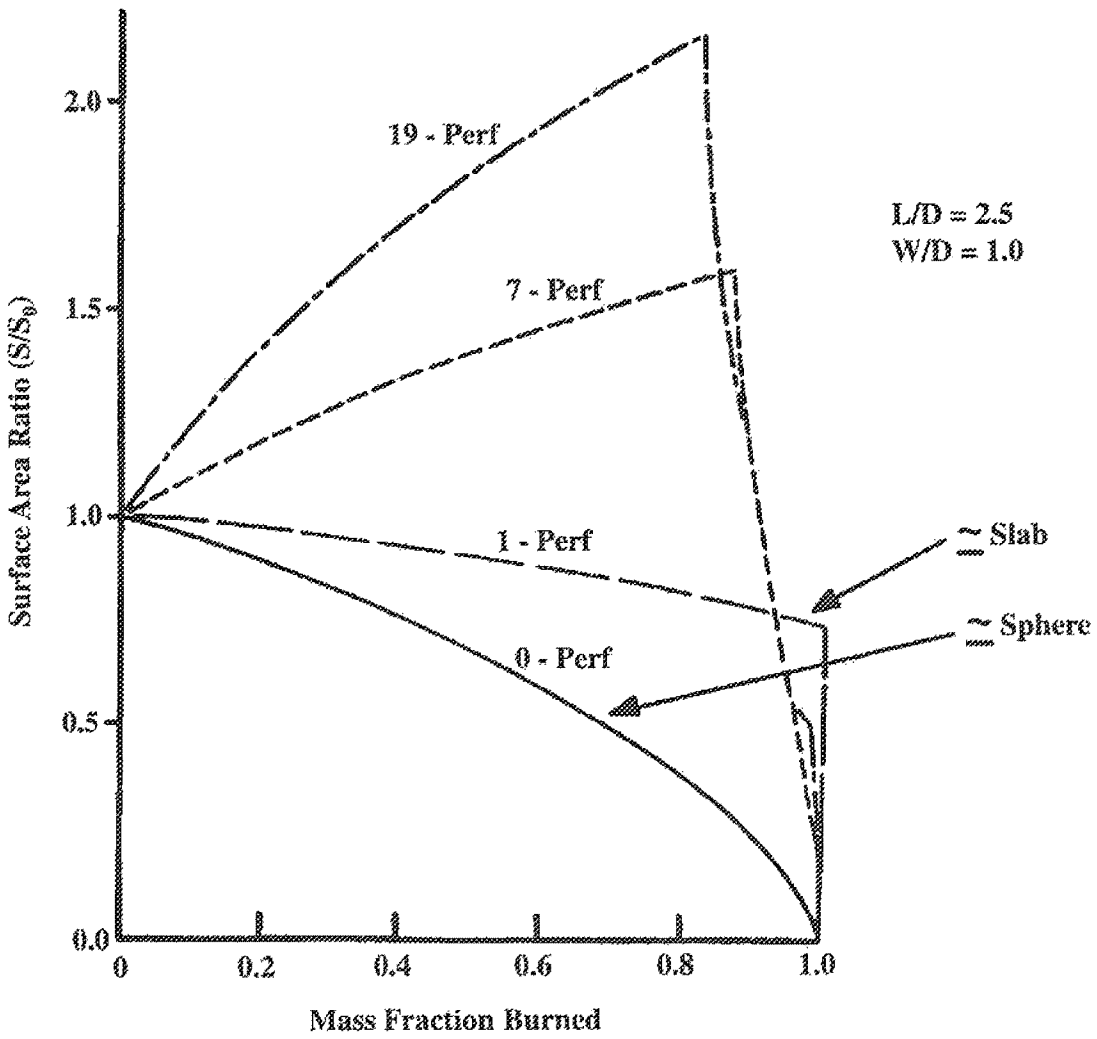
FIG. 2 (Prior Art)
FIG. 2 is a graphical representation illustrating progressivity as a function of grain geometry.

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Moreover, the units and values described in the description below and the drawings are merely examples. Accordingly, the examples should not be construed as limiting the scope of the embodiments herein.

The embodiments herein provide a process to produce a grain configuration which results in a constant pressure in a gun, rocket, or other weapon, over the ballistic cycle. This pressure profile maximizes the available work to the projectile during the interior ballistic cycle. The maximum performance of the grain configuration provided by the embodiments herein is 100%. Referring now to the drawings, and more particularly to FIGS. 3 through 9, where similar reference characters denote corresponding features consistently throughout the figures, there are shown preferred embodiments.

Figure 3:
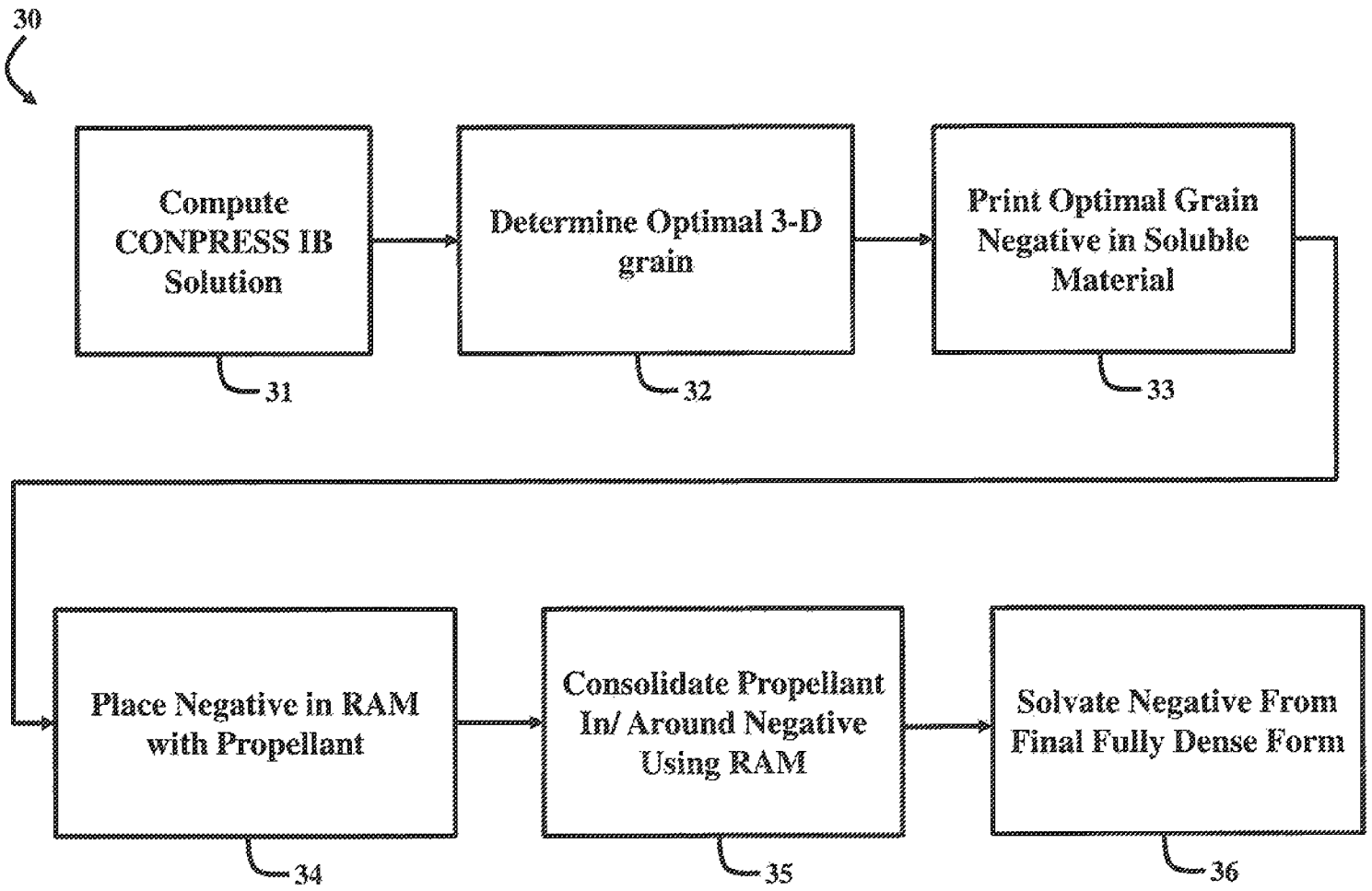
FIG. 3 is a flow diagram illustrating a process to create a 3D consolidated energetic grain structure.

The process (30) to generate the optimal grain of 100% provided by the embodiments herein involves interior ballistic calculations (31) to determine the surface area as a function of normal burn depth which produces a constant pressure, as shown in FIG. 3. These calculations are unique to each weapon/projectile combination. The resultant function is then used as a basis function for three-dimensional (3D) topological optimization (32) which generates results in a solid contiguous structure. From this structure, a negative is printed (33) in an additive manufacturing machine of soluble material. The negative is then placed (34) in a resonance acoustic mixer (RAM) in conjunction with the homogeneous uncured propellant which may or may not have many constituents. The utilization of the RAM does not preclude the use of other methods such as a melt case incorporating the grain negative to construct the optimal grain. The mixture is then densified and consolidated (35) surrounding the printed structure which provides the mold for the final propellant grain. When consolidation has been completed, the block of propellant/mold is then solvated (36) to remove the mold.

In one embodiment, a method of increasing the performance of a gun is provided. The grain progressivity and its effect on gun performance are provided. As suggested above, in conventional solutions, chemical progressivity can only be achieved by decreasing the energy available for output of the propellant. This in turn lowers the amount of available work that can be performed on the projectile, de facto lowering the gun performance. Given this reality, the embodiments herein remove such impediments and restrictions. The theoretically optimized performances is provided by non-deterred maximized energetic grain with a loading density, approximately 1.6 g/cm$^3$, which is at the theoretical maximum density (TMD).

Accordingly, the embodiments herein provide a technique to develop a novel progressive propellant grain geometry. This optimal grain geometry has a novel shape in which the surface area as a function of normal depth is more progressive than any previous grain design. To achieve a pressure profile like the idealized gun (see FIG. 1), the concept is to develop a grain's surface area such that it can produce constant pressure for as long as possible during the IB cycle. This pressure profile maximizes the theoretically available work to the projectile. As mentioned, conventional systems obtain between 80% and 95% maximum performances, whereas the result from the grain geometry provided by the embodiments herein is approximately 100% of a constant pressure calculation performance.

By removing limitations of producibility through the application of advanced manufacturing techniques, grain concepts will exist that incorporate feature such as internal gas-flow channels, embedded ignition, and variations in materials. The result is higher loading density, efficient and safe ignition, and performance approaching the "perfect" solution for the classical interior ballistics problem. This development has the possibility of impacting not only the propelling charge design but also the gun barrel design and energetic material formulations. The impact to the charge design is that every charge could be a maximum possible performance charge. In the area of gun design, the limits would be operational pressure. Under this new paradigm, increased down bore pressure, which historically tapers off, is maintained as peak gun pressure much farther down-bore. Energetic materials are affected by the permissible increased loading density from current values of less than 1 g/cm$^3$ to values close to TMD. This equates to a 5% muzzle velocity (or 10% muzzle energy) increase for tank guns and a 10% or more muzzle velocity increase for indirect-fire weapons.

Figure 4:
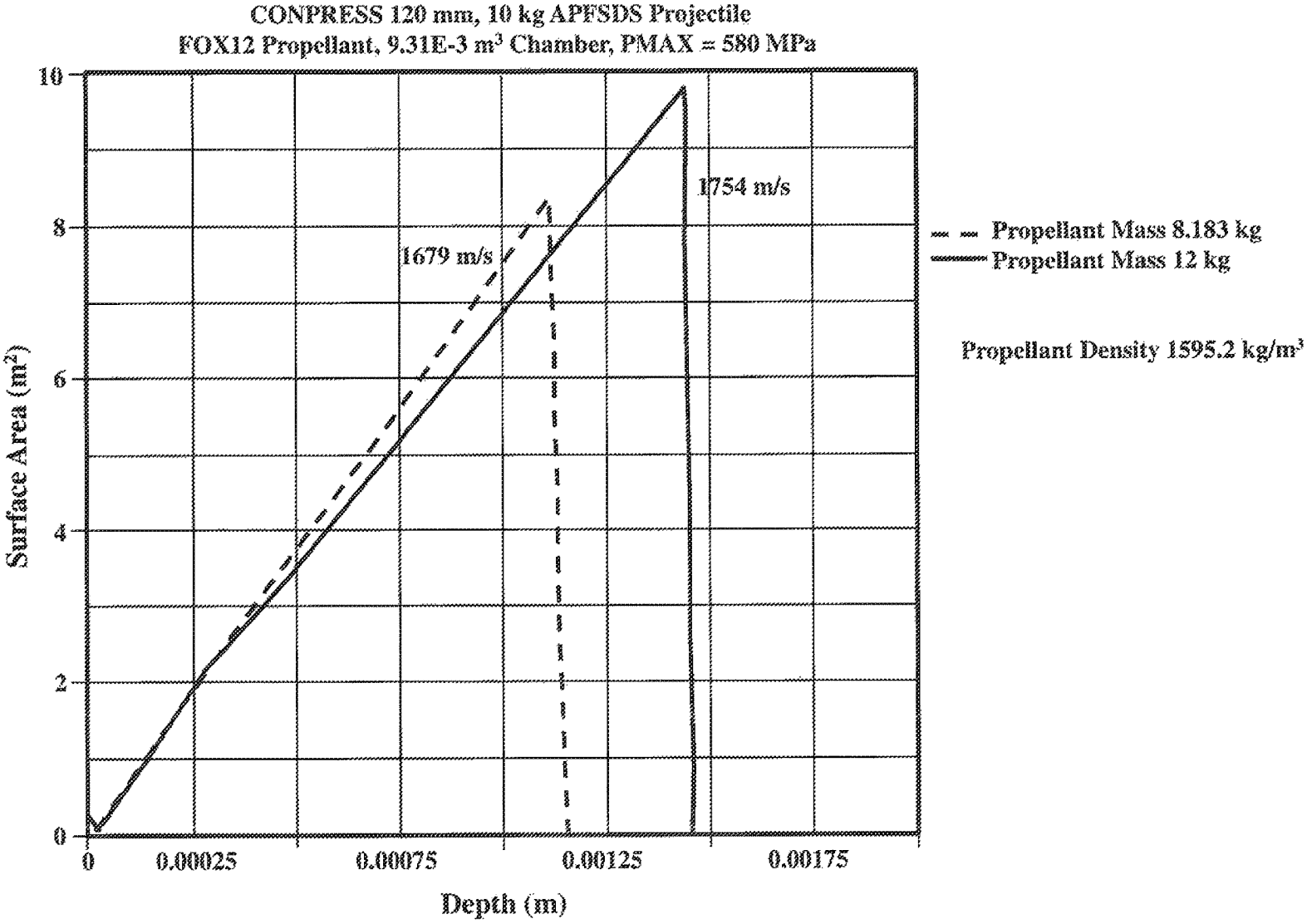
FIG. 4 is a graphical representation illustrating idealized surface area vs. depth plot for a M256 tank gun.

FIG. 4 shows examples of the surface area progression required to produce constant pressures in an M256 tank cannon firing a propellant made with FOX12, or N-guanylurea-dinitramide (MK99). The negative grain, with all of its intricate structure, is contiguous in nature and is able to survive the consolidation process inside a RAM mixer. After consolidation, the negative is entirely solvated out. The concept of printing the grain negative provides the additional ability to include passage for embedded coincidental ignition locations in the grain. Proper application of this may increase loading density dramatically and, with it, improves the performance of the weapon, as shown in FIG. 4.

The embodiments herein first experimentally define the material requirements for propellant casting, considering available additive manufacturing materials. Water-soluble materials are an enabler of safe production of negative grain propellant molds. The RAM process is used to generate the solid propellant around and in the negative grain. Because of high viscosity and the highly-detailed structure of the propellants, RAM is an ideal process for consolidating the propellant around and in the 3D printed negative. The resultant solid form includes processing to solvate and removes the printed negative. The final form is then ready for evaluation in a closed bomb for effective burn rate analysis and technique validation.

The computational algorithms for both the forward problem (determining a surface area vs. depth curve) and the inverse problem (determining the geometry that fits a given surface area vs. depth curve) are described below. The forward problem based on Piobert's Law can be expressed in two ways: either as a partial differential equation (PDE) of a Hamilton-Jacobi type or as a Minkowski sum of the geometry with a sphere of a given size (also known as an offset geometry). The Hamilton-Jacobi equation for the idealized burn rate computation is given as the first-order PDE $\partial\rho/\partial t=-r|\nabla\rho|$, where $\rho$ is the density of the propellant, and r is a given burn rate. This model can be solved using a finite-element method and is appropriate for density-based or volume-based topology optimization algorithms. Another approach, which is appropriate for surface-based optimization algorithms, uses the Minkowski sum: the idealized burn process can be described using the Minkowski sum of the given geometry and a sphere with radius equal to the burn depth. This approach provides that the surface area can be computed from any given arbitrary burn depth without the need to progress through a simulation as with the PDE approach.

Inverse problems are essentially optimization problems—in this case, topology optimization. Topology optimization is a field dedicated to generating optimal geometries for a given problem, typically structural engineering. Material distribution techniques to design propellant grains that fit a given surface area versus burn depth curve are described below. Several techniques are described because, as mentioned previously, there are two ways to solve the forward problem, each of which suggests a different optimization algorithm. In addition, the Hamilton-Jacobi-type model resembles a topology optimization technique known as a "level-set" method.

Figure 5A:
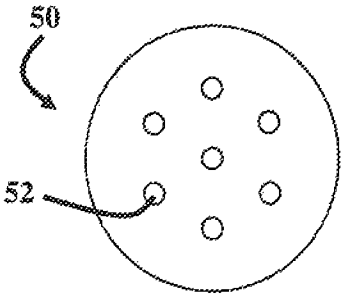
FIGS. 5A through 5C are schematic diagrams of a 7-perf grain.
Figure 5B:
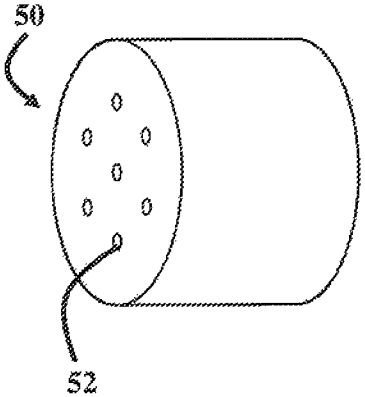
Figure 5C:
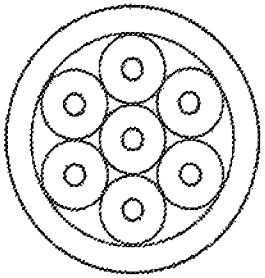
Figure 6:
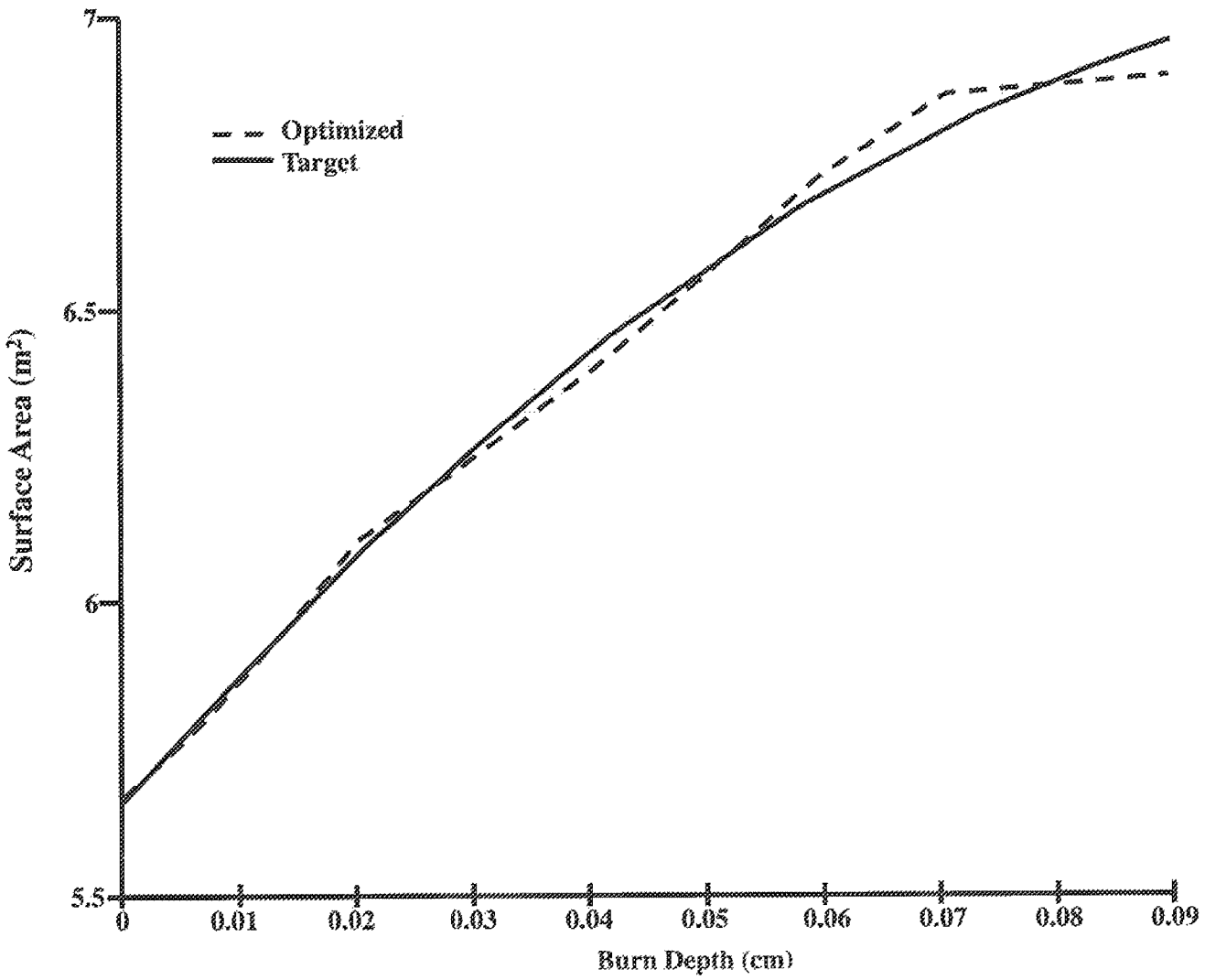
FIG. 6 is a graphical representation illustrating surface area vs. burn depth according to a first experimental attempt.
Figure 7:
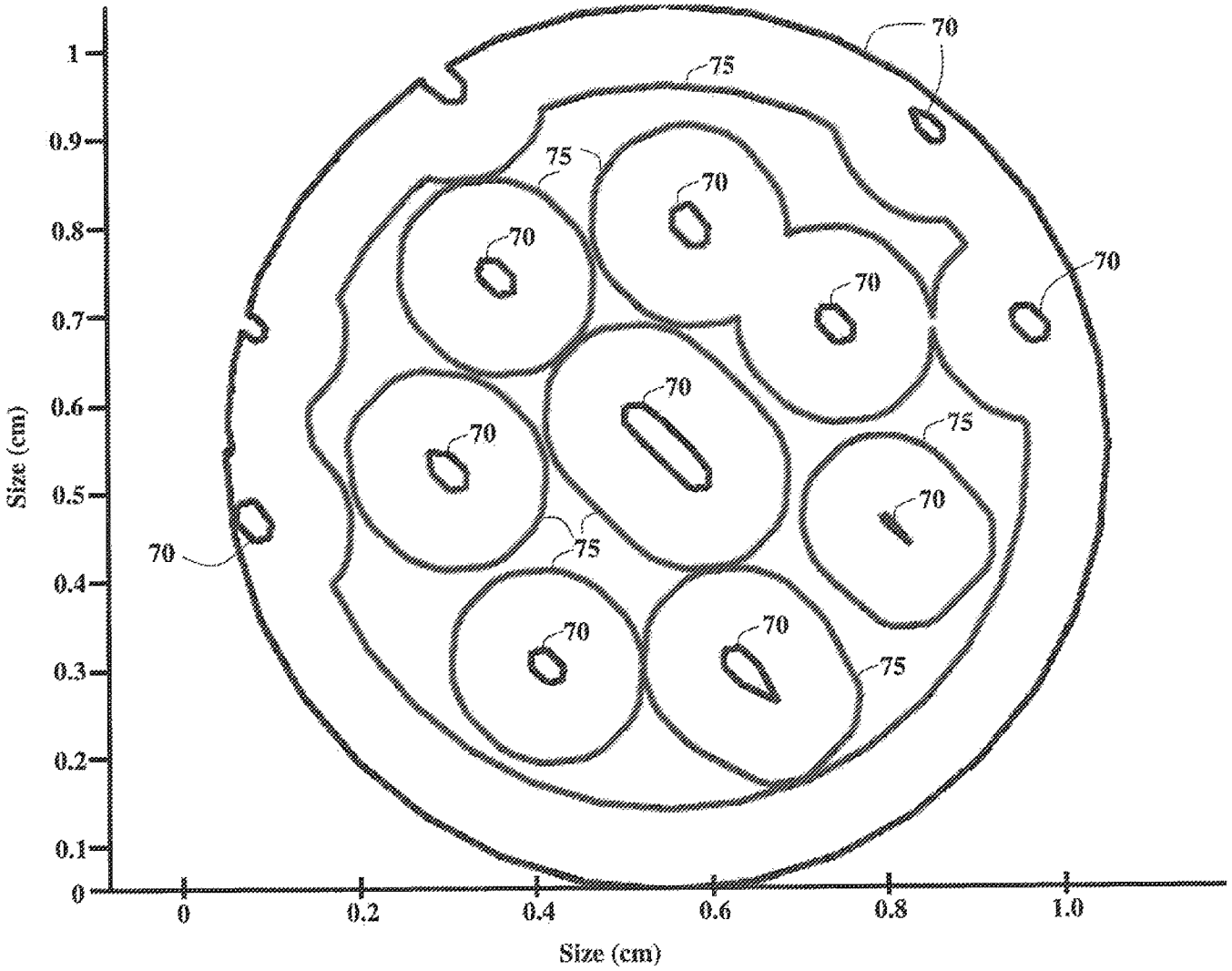
FIG. 7 is a graphical representation illustrating the propellant geometry before and at silvering according to a first experimental attempt.

A preliminary experiment was performed to test the feasibility of the approach provided by the embodiments herein. As shown in FIGS. 5A through 5C, the surface area versus burn depth curve for a cylinder 50 with seven perforations 52 is generated and used as a target for an inverse algorithm. FIGS. 5A and 5B illustrate schematic diagrams of a 7-perf grain. FIG. 5C illustrates a schematic diagram of the same grain but at the point of slivering. In a well-designed grain the perforations burning outward all meet at the same time as the outer surface (burning inward) meets. The surface area vs. burn depth curve for the 7-perf grain is shown in FIG. 6, up to the point of slivering, by the target line. The approach used is a binary 2-D genetic algorithm paired with a square region, discretized in a 40-by-40 grid. The forward solver models Piobert's Law with a heuristic method that propagates line segments along their normal direction at each depth step. The first experimental attempt was made using the 7-perf grain surface area progression as a starting point to investigate if the technique could reproduce the 7-perf grain. No restrictions were placed upon the scheme other than the outer circular shape. The convergence is seen in FIG. 7 with a grain of unexpected shape. This includes eleven perforations and two partial perforations in the outer surface. The initial shapes 70 are shown before burning with the shapes 75 at the point of slivering. Unlike a well-designed grain, this grain at slivering has some outer edge defects. As noted earlier in a well-designed grain, the perforations and the outer burning surfaces should meet at the point of slivering, but as can be seen in FIG. 7, there are significant "slivers" in this grain. The problem with slivers is that they are regressive in burning. Interestingly, in FIG. 6 the progressivity matches fairly well with that of the 7-perf grain in spite of the grain geometry deviations.

Figure 8:
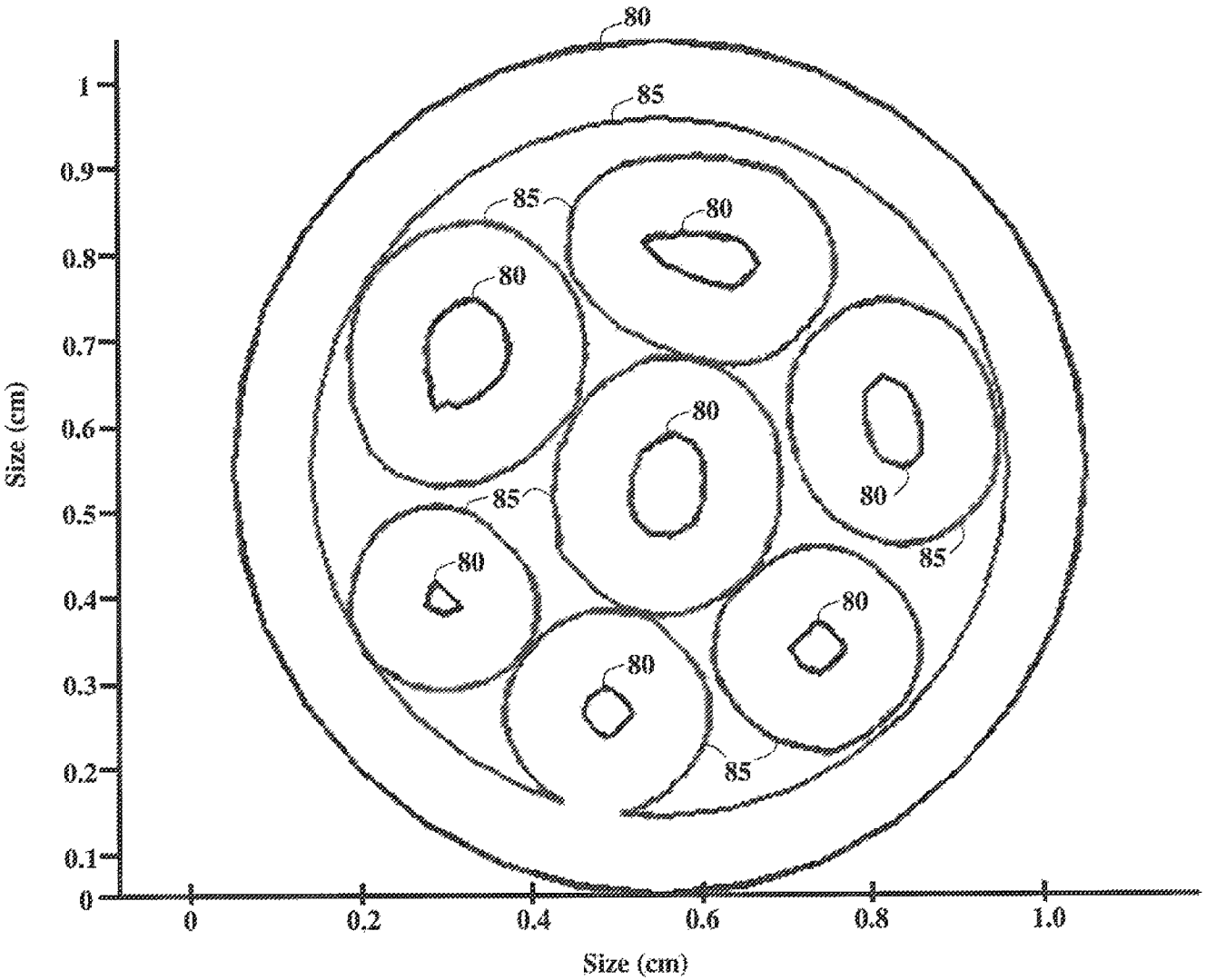
FIG. 8 is a graphical representation illustrating the propellant geometry before and at silvering according to a second experimental attempt.
Figure 9:
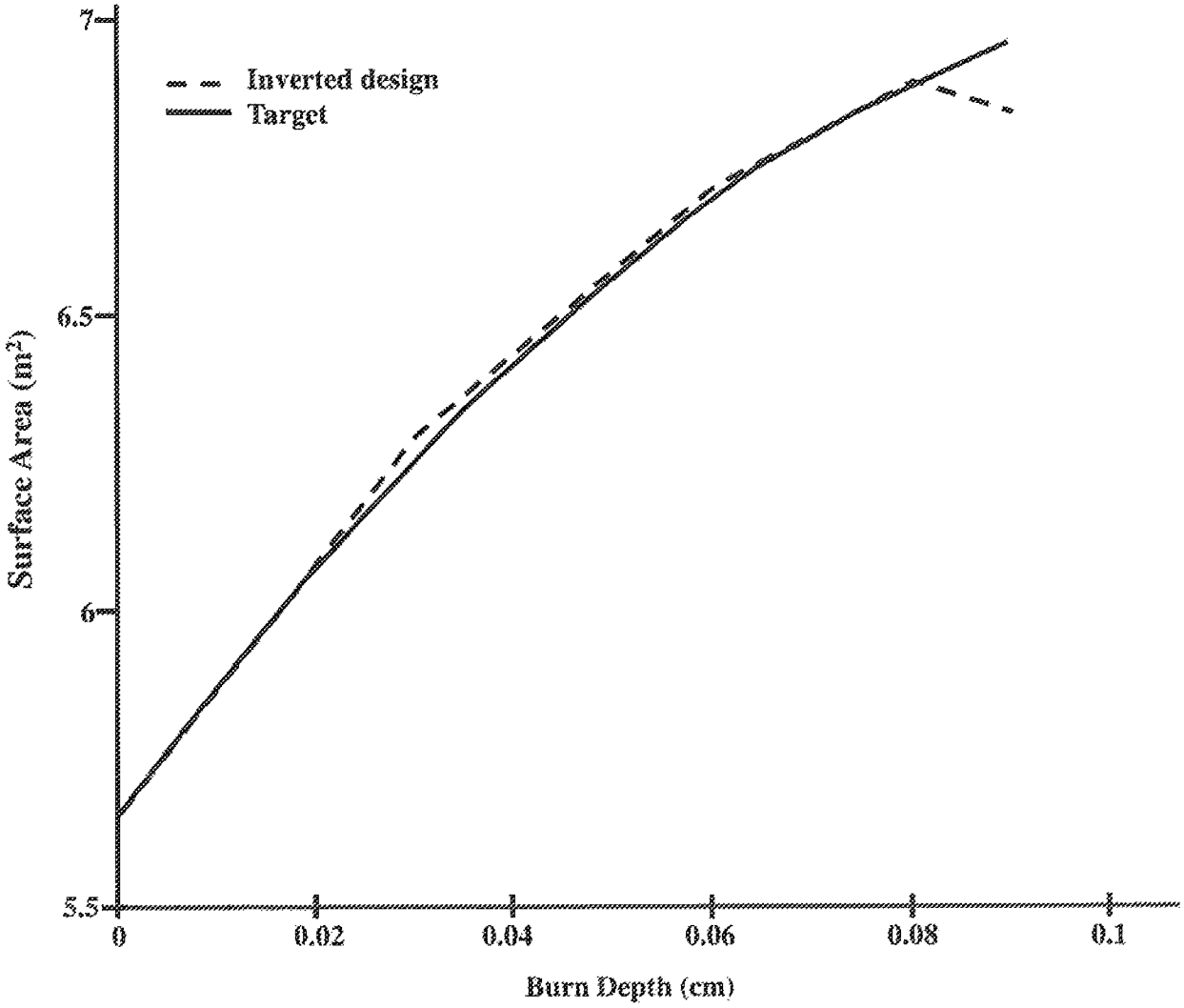
FIG. 9 is a graphical representation illustrating surface area vs. burn depth according to a second experimental attempt.

After limiting effects near the outer edge of the grain, this approach produced a result strikingly similar to the original geometry, as shown in FIG. 8. The original shapes 80 are provided, and the shapes 85 are shown at the time of slivering. The resultant progressivity plot, shown in FIG. 9, matches that of the 7-perf grain much better than the first experimental attempt.

The embodiments herein provide a method to design and manufacture a propellant grain that has the potential to optimize the IB performance of a gun. The techniques provided by the embodiments herein allow weapon designers to redesign weapons for increased down-bore pressure. In addition, if the projectile has a specific acceleration limit, then the charge can be designed to meet that requirement. The technique provided by the embodiments herein enable propulsion scientists and engineers to take advantage of advanced energetic propellants to safely and efficiently extract the work in a controlled fashion.

Generally, the methodology provided by the embodiments herein begins with the generation of an optimal surface area as a function of the depth profile developed for a specific weapon and projectile for IB. This profile is then used as a target function for a topological optimization process to generate a 3D form of the propellant grain. The negative of the resultant propellant grain geometry is then created using additive manufacturing. The material used to generate the negative is one which is soluble in a material in which the energetic material is insoluble. The negative is then placed in RAM of suitable size along with the energetic material in an uncured form. Applying the RAM fully mixes and densities the desired grain in and around the printed negative generating a solid block of energetic material with the embedded negative grain. Upon completion of the RAM process, the negative is then solvated out of the matrix leaving the 3D optimized grain.

The embodiments herein provide a technique whereby the resulting grain shape produces an increase in muzzle velocity for both direct fire and indirect fire weapons. The resultant form function maximizes the performance of the weapon given its constraints of chamber volume and peak operating pressure. The embodiments herein overcome the previous limitations in the industry of current propellant methods by producing a grain which maximizes a weapon's performance. In this regard, the embodiments herein achieve a surface area to mass fraction burned ratio of approximately 5 or more compared with the conventional methods which achieve a surface area to mass fraction burned ratio of approximately 2. Furthermore, the embodiments herein provide an environmental improvement over conventional techniques in that there is no waste energetics during manufacturing nor are there solvents necessarily used in the processing since RAM enables some formulations to be solventless.

The embodiments herein provide a substantial improvement in the art of grain geometry/configuration. The embodiments herein are able to achieve the optimal performance by using IB concepts coupled with surface optimization coupled with additive, manufacturing and further coupled with resonance acoustic mixing. Moreover, the embodiments herein utilize surface optimization to develop a solid structure producing the constant pressure IB profile. Furthermore, the embodiments herein utilize the application of the RAM mixer with a soluble negative to produce a propellant grain. Additionally, the embodiments herein utilize the concept of printing a soluble negative for propellant grain manufacturing. Also, the embodiments herein use a negative with other consolidation/filling methods for constructing the grain shape such as a metal cast.

Although the technique has been described here for gun propellant grain designs, the method is equally applicable to other polymeric or heterogeneous mixtures that do not lend themselves to additive manufacturing methods where fully dense material properties are required. This could include rocket motor grains that would have geometries impossible with a removable mandrill, in addition to solid structures with occluded or embedded shapes and, interestingly, time-release pharmaceuticals.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the at meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

What is claimed is:

1. A method of manufacturing and optimizing energetic propellant grains, said method comprising:

generating an optimal surface area to mass fraction burned ratio profile for a predetermined solid structure comprising propellant grains;

using said profile as a target function of a topological optimization process to generate a three-dimensional (3D) form of a propellant grain;

developing a negative of the 3D form of said propellant grain;

mixing and densifying said negative with an energetic material in an uncured form in a mixer to create a structure comprising said energetic material and embedded negative; and solvating said negative from said structure, wherein said negative comprises a 3D propellant grain.

2. The method of claim 1, wherein the developing of said negative of said 3D form of said propellant grain occurs using a predetermined material in an additive manufacturing process.

3. The method of claim 2, wherein said negative is soluble in said predetermined material, and wherein said energetic material is insoluble in said predetermined material.

4. The method of claim 1, wherein said optimal surface area to mass fraction burned ratio is at least 5.

5. The method of claim 1, wherein the generating of said optimal surface area to mass fraction burned ratio profile for a predetermined solid structure comprises a constant pressure IB profile.

6. The method of claim 1, wherein said 3D form of said propellant grain comprises a solid contiguous structure.

7. The method of claim 1, wherein said mixer comprises a resonant acoustic mixer (RAM).

8. The method of claim 1, wherein said 3D form of said propellant grain comprises a rocket motor grain.

* * * * *